US009535350B2

(12) United States Patent
Kikawa et al.

(10) Patent No.: US 9,535,350 B2
(45) Date of Patent: Jan. 3, 2017

(54) METHOD FOR PRODUCING GROUND TONER

(71) Applicant: SHARP KABUSHIKI KAISHA, Sakai, Osaka (JP)

(72) Inventors: Keiichi Kikawa, Sakai (JP); Tadayuki Sawai, Sakai (JP); Yoritaka Tsubaki, Sakai (JP); Keigo Mitamura, Sakai (JP); Yui Kawano, Sakai (JP); Shintaro Fukuoka, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 15/239,114

(22) Filed: Aug. 17, 2016

(65) Prior Publication Data

US 2016/0357121 A1 Dec. 8, 2016

Related U.S. Application Data

(62) Division of application No. 14/382,135, filed as application No. PCT/JP2013/057047 on Mar. 13, 2013.

(30) Foreign Application Priority Data

Mar. 15, 2012 (JP) ..... 2012-059402

(51) Int. Cl.

| | |
|---|---|
| ***G03G 9/087*** | (2006.01) |
| ***G03G 9/08*** | (2006.01) |
| ***G03G 9/107*** | (2006.01) |

(52) U.S. Cl.

CPC ..... *G03G 9/0821* (2013.01); *G03G 9/081* (2013.01); *G03G 9/08755* (2013.01); *G03G 9/107* (2013.01)

(58) Field of Classification Search

CPC ..... G03G 9/08708; G03G 9/08755; G03G 9/08795; G03G 9/08797; G03G 9/081; G03G 15/00; G03G 15/08

See application file for complete search history.

(56) References Cited

U.S. PATENT DOCUMENTS

| | | | | |
|---|---|---|---|---|
| 5,840,457 | A | 11/1998 | Urawa et al. | |
| 2007/0259283 | A1 | 11/2007 | Abe et al. | |
| 2009/0035688 | A1* | 2/2009 | Abe | G03G 9/0806 430/110.3 |

FOREIGN PATENT DOCUMENTS

| | | |
|---|---|---|
| JP | 7-219270 | 8/1995 |
| JP | 10-97098 | 4/1998 |
| JP | 2002-278138 A | 9/2002 |

(Continued)

OTHER PUBLICATIONS

International Search Report for PCT/JP2013/057047, mailed Jun. 18, 2013.

(Continued)

*Primary Examiner* — Peter Vajda
(74) *Attorney, Agent, or Firm* — Nixon & Vanderhye P.C.

(57) ABSTRACT

Toner of one aspect of the present invention has a weight average molecular weight Mw of 30,000≤Mw≤95,263 as determined from a molecular weight distribution based on GPC, includes a THF-insoluble gel component at a weight proportion of less than 5%, and includes components each having a molecular weight of 500 to 1500 which components have an area occupancy of 4% to 10% on a chart of the molecular weight distribution based on GPC.

3 Claims, 4 Drawing Sheets

(56) References Cited

FOREIGN PATENT DOCUMENTS

| | | | |
|---|---|---|---|
| JP | 2003-005432 | | 1/2003 |
| JP | 2003-280244 | A | 10/2003 |
| JP | 2008-158252 | A | 7/2008 |
| WO | 2007/099693 | A1 | 9/2007 |

OTHER PUBLICATIONS

JP language Written Opinion of the International Searching Authority for PCT/JP2013/057047, mailed Jun. 18, 2013.
Japanese Office Action mailed Jun. 2, 2015 in Japanese Application 2012-059402.
Diamond, "Handbook of Imaging Materials," Marcel Dekker, NY, NY 1991. pp. 380-382.
Office Action in related co-pending U.S. Appl. No. 14/382,135; Notification date of Oct. 20, 2015, 9 pages.
Office Action in related co-pending U.S. Appl. No. 14/382,135; Notification date of May 18, 2016, 10 pages.

* cited by examiner

METHOD FOR PRODUCING GROUND TONER

CROSS REFERENCE

This application is a divisional of U.S. patent application Ser. No. 14/382,135, filed Aug. 29, 2014, pending, which is the U.S. National Phase of International Application No. PCT/JP2013/057047, filed Mar. 13, 2013 which designated in the U.S. and claims priority to foreign application JP 2012-059402, filed Mar. 15, 2012, the entire contents of each of which are hereby incorporated by reference.

TECHNICAL FIELD

The present invention relates to toner, a two component developer, an image forming apparatus that uses the toner or two component developer, and an image forming method.

BACKGROUND ART

An electrophotographic image forming apparatus makes visible an electrostatic latent image on a photoreceptor surface with use of toner. There is a demand for toner that allows a high quality image to be formed. Patent Literature 1, for example, discloses "toner that includes a binder resin containing a tetrahydrofuran (THF)-insoluble matter in an amount of 5 weight % or less, where in a molecular weight distribution based on gel permeation chromatography (GPC) of a THF-soluble matter in the binder resin, components each having a molecular weight of less than 50,000 have a content (M1) of 40% to 70%, components each having a molecular weight of 50,000 to 500,000 have a content (M2) of 20% to 45%, components each having a molecular weight of greater than 500,000 have a content (M3) of 2% to 25%, and M1≥M2>M3". Note that M1, M2, and M3 are expressed in weight % on the basis of the area ratio in a GPC chromatogram.

Patent Literature 1 further discloses that using the above toner "makes it possible to form, with high transfer efficiency, a high quality image having moderate glossiness that is easily adjustable.

CITATION LIST

Patent Literature 1

Japanese Patent Application Publication, Tokukaihei, No. 10-97098 A (Publication Date: Apr. 14, 1998)

SUMMARY OF INVENTION

Technical Problem

The toner of Patent Literature 1 above, however, has relatively high molecular weight distribution. The toner should thus be poor in grindability and consequently poor in production efficiency.

The present invention has been accomplished in view of the above problem. It is an object of the present invention to provide (i) toner and a two component developer each of which can be produced with high efficiency and allows a high quality image to be formed, (ii) an image forming apparatus that uses the toner or two component developer, and (iii) an image forming method.

Solution to Problem

In order to solve the above problem, a toner of one mode of the present invention is a toner, including: a binder resin; a coloring agent; a release agent; and a charge control agent, the toner having a weight average molecular weight Mw of 30,000≤Mw≤95,263 as determined from a molecular weight distribution based on gel permeation chromatography (GPC), the toner including a tetrahydrofuran-insoluble gel component at a weight proportion of less than 5%, the toner including components each having a molecular weight of 500 to 1500 which components have an area occupancy of 4% to 10% on a chart of the molecular weight distribution based on GPC.

Advantageous Effects of Invention

As described above, a toner of one mode of the present invention is a toner, including: a binder resin; a coloring agent; a release agent; and a charge control agent, the toner having a weight average molecular weight Mw of 30,000≤Mw≤95,263 as determined from a molecular weight distribution based on gel permeation chromatography (GPC), the toner including a tetrahydrofuran-insoluble gel component at a weight proportion of less than 5%, the toner including components each having a molecular weight of 500 to 1500 which components have an area occupancy of 4% to 10% on a chart of the molecular weight distribution based on GPC.

With the above arrangement, the toner particles, which have a weight average molecular weight Mw of 30,000≤Mw≤95,263, are advantageously high in elasticity, and also provide good releasability in a case where a toner image is fixed with use of a belt-type fixing device. Toner particles having a weight average molecular weight Mw within the above range will, however, be poor in grindability, and thus result in poor production efficiency. Such toner particles will be even more difficult to grind in a case where the toner particles contain a tetrahydrofuran-insoluble gel component at a weight proportion of less than 5% which gel component may serve as a grinding start point when the toner particles are ground. In view of this, the toner particles of the above arrangement contain components each with a molecular weight of 500 to 1500, the components having an area occupancy of 4% to 10% on a chart of the molecular weight distribution based on GPC. This serves to provide a new grinding start point inside the toner particles for improved grindability, that is, improved toner productivity.

Further, in a case where the components each with a molecular weight of 500 to 1500 have an area occupancy of 4% to 10% in the molecular weight distribution based on GPC, the toner as fixed will advantageously have a smooth surface and a stable gloss value.

The above arrangement can, as described above, provide toner that has improved productivity in terms of grindability and a stable gloss value after being fixed.

DESCRIPTION OF EMBODIMENTS

Figure 1:
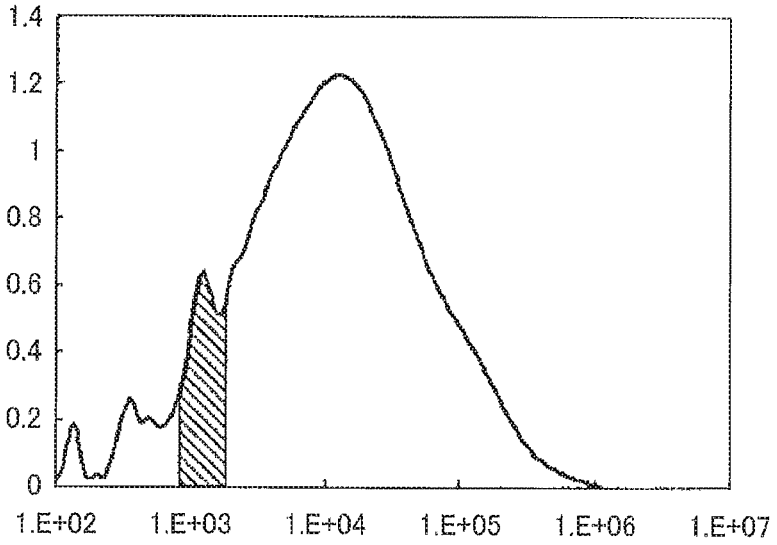
FIG. 1 is a graph illustrating a molecular weight distribution of toner of an embodiment of the present invention.

One embodiment of the present invention is described below with reference to FIGS. 1 through 3.

[Toner]

The description below first deals with toner (toner particles) of the present embodiment. The toner of the present embodiment contains a binder resin, a coloring agent, a release agent, and a charge control agent. The toner particles of the present embodiment contain not only a binder resin but also, as a grinding aid resin, a resin (additive resin) having a physical property value different from that of the binder resin. Further, the present embodiment may further include an external additive as necessary that adheres to surfaces of the toner particles.

The toner particles of the present embodiment have a weight average molecular weight Mw of 30,000≤Mw≤95,263 as determined from a molecular weight distribution based on gel permeation chromatography (GPC). The toner particles contain a tetrahydrofuran (THF)-insoluble gel component at a weight proportion of less than 5%. Further, as illustrated in FIG. 1, the toner particles contain components each having a molecular weight of 500 to 1500 which components have an area occupancy of 4% to 10% on a chart of the molecular weight distribution based on GPC.

The toner particles, which have a weight average molecular weight Mw of 30,000≤Mw≤95,263, are advantageously high in elasticity, and also provide good releasability in a case where a toner image is fixed with use of a belt-type fixing device. Toner particles simply having a weight average molecular weight Mw within the above range will, however, be poor in grindability, and thus result in poor production efficiency. Such toner particles will be even more difficult to grind in a case where the toner particles contain a THF-insoluble gel component at a weight proportion of less than 5% which gel component may serve as a grinding start point when the toner particles are ground. In view of this, the toner particles of the present embodiment contain components each with a molecular weight of 500 to 1500, the components having an area occupancy of 4% to 10% on a chart of the molecular weight distribution based on GPC. This serves to provide a new grinding start point inside the toner particles for improved grindability, that is, improved toner productivity.

Further, in a case where the components each with a molecular weight of 500 to 1500 have an area occupancy of 4% to 10% on a chart of the molecular weight distribution based on GPC, the toner as fixed will advantageously have a smooth surface and a stable gloss value.

If the components each with a molecular weight of 500 to 1500 have an area occupancy of less than 4% on a chart of the molecular weight distribution based on GPC, the grindability improving effect mentioned above may not be sufficient. If the area occupancy is greater than 10%, the toner particles will be excessively ground, with the result of a poor yield and decreased production efficiency.

The toner particles of the present embodiment, as described above, have improved productivity in terms of grindability and a stable gloss value after being fixed.

The present embodiment, as described below, determines the weight average molecular weight Mw of toner particles from a molecular weight distribution based on gel permeation chromatography (GPC). Although a toner particle is actually not a molecule but a mixture, the present embodiment handles toner particles as molecules, hence the weight average "molecular" weight Mw.

Among all the components of the toner, it is mainly the binder resin and the grinding aid resin that contribute to the weight average molecular weight Mw of the toner particles. No contribution is made to Mw by any component undissolved in an eluant for GPC. This means that in a case where the eluant is THF, no contribution is made to Mw by a THF-insoluble release agent. Further, the coloring agent may, depending on the pigment included in the coloring agent, be dissolved in THF in a small amount, which is, however, not large enough to change the molecular weight distribution. In addition, the charge control agent, which is added in only a trace amount, has almost no influence on the molecular weight distribution.

The toner particles may be prepared through a publicly known method such as a kneading/grinding method and polymerization method. Preparing toner particles through a kneading/grinding method involves (i) mixing a binder resin, a coloring agent, a charge control agent, a release agent, and other additives in a mixer such as a Henschel mixer, Super Mixer, Mechano Mill, and a Q-type mixer, (ii) fusing and kneading the material mixture in a kneader, (iii) cooling and solidifying the resulting kneaded product, (iv) grinding the solidified product in an air-type mill such as a jet mill, and (v) as necessary adjusting the particle sizes of the resulting particles as ground, for example classifying the particles, to finally produce toner particles.

Examples of the binder resin include publicly known styrene resins, acrylic resins, and polyester resins. The binder resin is particularly preferably a linear or nonlinear polyester resin among others. Polyester resins are superior in that they improve all of (i) mechanical strength of the toner (making it less likely to leave fine powder), (ii) fixing property of the toner (making it less likely for the toner to be released from a sheet after being fixed), and (iii) resistance of the toner to hot offset.

A polyester resin may be prepared through polymerization of a monomer composition including a polyhydric alcohol and polybasic acid each having a valence of 2 or greater.

Examples of a bivalent alcohol include (i) diols such as ethylene glycol, diethylene glycol, triethylene glycol, 1,2-propylene glycol, 1,3-propylene glycol, 1,4-butandiol, neopentyl glycol, 1,4-butenediol, 1,5-pentane diol, and 1,6-hexanediol and (ii) bisphenol-A alkylene oxide adducts such as bisphenol-A, hydrogenated bisphenol-A, polyoxyethylated bisphenol-A, and polyoxypropylated bisphenol-A.

Examples of a bivalent polybasic acid include alkenyl succinic acids and alkyl succinic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, an anhydride or lower alkyl ester of any of the above acids, n-dodecenyl succinic acid, and n-dodecyl succinic acid.

The monomer composition may as necessary include a polyhydric alcohol or polybasic acid each having a valence of 3 or greater.

Examples of the polyhydric alcohol having a valence of 3 or greater include sorbitol, 1,2,3,6-hexanetetrol, 1,4-sorbitan, pentaerythritol, dipentaerythritol, tripentaerythritol, saccharose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxy methylbenzene.

Examples of the polybasic acid having a valence of 3 or greater include 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and an anhydride of any of the above.

The toner particles of the present embodiment include not only a binder resin but also, as a grinding aid resin, a resin (additive resin) having a physical property value different from that of the binder resin. In a case where the binder resin is a polyester resin, the additive resin is suitably a styrene resin.

In a case where the toner particles include a polyester resin as the binder resin and a styrene resin as the additive resin, it is easy to adjust the components each with a molecular weight of 500 to 1500 so that its area occupancy on a chart of the molecular weight distribution based on GPC is 4% to 10%.

The components each having a relatively low molecular weight (that is, a molecular weight of 500 to 1500) are easily adjustable in a case where the additive resin is a styrene resin, whereas the main resin (binder resin), other than the styrene resin, is suitably a polyester resin. Further, a polyester resin and a styrene resin have low compatibility with each other, which allows the styrene resin as an additive resin to easily serve as a grinding start point. This arrangement can enhance the grindability improving effect.

The coloring agent may be a publicly known pigment or dye generally used in toner. Examples of the coloring agent for black toner include carbon black and magnetite.

Examples of the coloring agent for yellow toner include (i) acetoacetic acid arylamide monoazo yellow pigments such as C.I. Pigment Yellow 1, C.I. Pigment Yellow 3, C.I. Pigment Yellow 74, C.I. Pigment Yellow 97, and C.I. Pigment Yellow 98, (ii) acetoacetic acid arylamide disazo yellow pigments such as C.I. Pigment Yellow 12, C.I. Pigment Yellow 13, C.I. Pigment Yellow 14, and C.I. Pigment Yellow 17, (iii) condensed monoazo yellow pigments such as C.I. Pigment Yellow 93 and C.I. Pigment Yellow 155, (iv) other yellow pigments such as C.I. Pigment Yellow 180, C.I. Pigment Yellow 150, and C.I. Pigment Yellow 185, and (v) yellow dyes such as C.I. Solvent Yellow 19, C.I. Solvent Yellow 77, C.I. Solvent Yellow 79, and C.I. Disperse Yellow 164.

Examples of the coloring agent for red toner include (i) red or crimson pigments such as C.I. Pigment Red 48, C.I. Pigment Red 49:1, C.I. Pigment Red 53:1, C.I. Pigment Red 57, C.I. Pigment Red 57:1, C.I. Pigment Red 81, C.I. Pigment Red 122, C.I. Pigment Red 5, C.I. Pigment Red 146, C.I. Pigment Red 184, C.I. Pigment Red 238, and C.I. Pigment Violet 19, and (ii) red dyes such as C.I. Solvent Red 49, C.I. Solvent Red 52, C.I. Solvent Red 58, and C.I. Solvent Red 8.

Examples of the coloring agent for blue toner include (i) blue dyes and pigments of copper phthalocyanine and a derivative thereof such as C.I. Pigment Blue 15:3 and C.I. Pigment Blue 15:4, and (ii) green pigments such as C.I. Pigment Green 7 and C.I. Pigment Green 36 (Phthalocyanine Green).

The coloring agent is contained in an amount preferably within an approximate range of 1 to 15 parts by weight, more preferably within the range of 2 to 10 parts by weight, with respect to 100 parts by weight of the binder resin.

The charge control agent may be a publicly known charge control agent. Examples of a charge control agent for negatively charging toner include chrome azo complex dye; iron azo complex dye; cobalt azo complex dye; a chromium, zinc, aluminum, or boron complex or salt compound of salicylic acid or derivative thereof; a chromium, zinc, aluminum, or boron complex or salt compound of naphthol acid or derivative thereof; a chromium, zinc, aluminum, or boron complex or salt compound of benzilic acid or derivative thereof; a long-chain alkyl carboxylate; and a long-chain alkyl sulfonate.

Examples of a charge control agent for positively charging toner include nigrosine dye, a derivative thereof, a triphenylmethane derivative, and derivatives of quaternary ammonium salt, quarternary phosphonium salt, quarternary pyridinium salt, guanidine salt, and amidine salt.

The charge control agent is contained in an amount preferably within the range of 0.1 part by weight to 20 parts by weight, more preferably within the range of 0.5 part by weight to 10 parts by weight, with respect to 100 parts by weight of the binder resin.

Examples of the release agent include (i) synthetic wax of polypropylene, polyethylene, or Fischer-Tropsch, (ii) petroleum wax and its modified wax such as paraffin wax, a derivative thereof, microcrystalline wax, and a derivative thereof, and (iii) plant wax such as carnauba wax, rice wax, and Candelilla wax. Containing the release agent in toner can improve releasing property of the toner with respect to a fixing roller or fixing belt, and can thus prevent hot/cold offset from occurring when the toner is fixed.

The release agent is contained in an amount preferably within the range of 2 parts by weight to 10 parts by weight, more preferably within the range of 3 parts by weight to 8 parts by weight, with respect to 100 parts by weight of the binder resin.

[Image Forming Apparatus]

Figure 2:
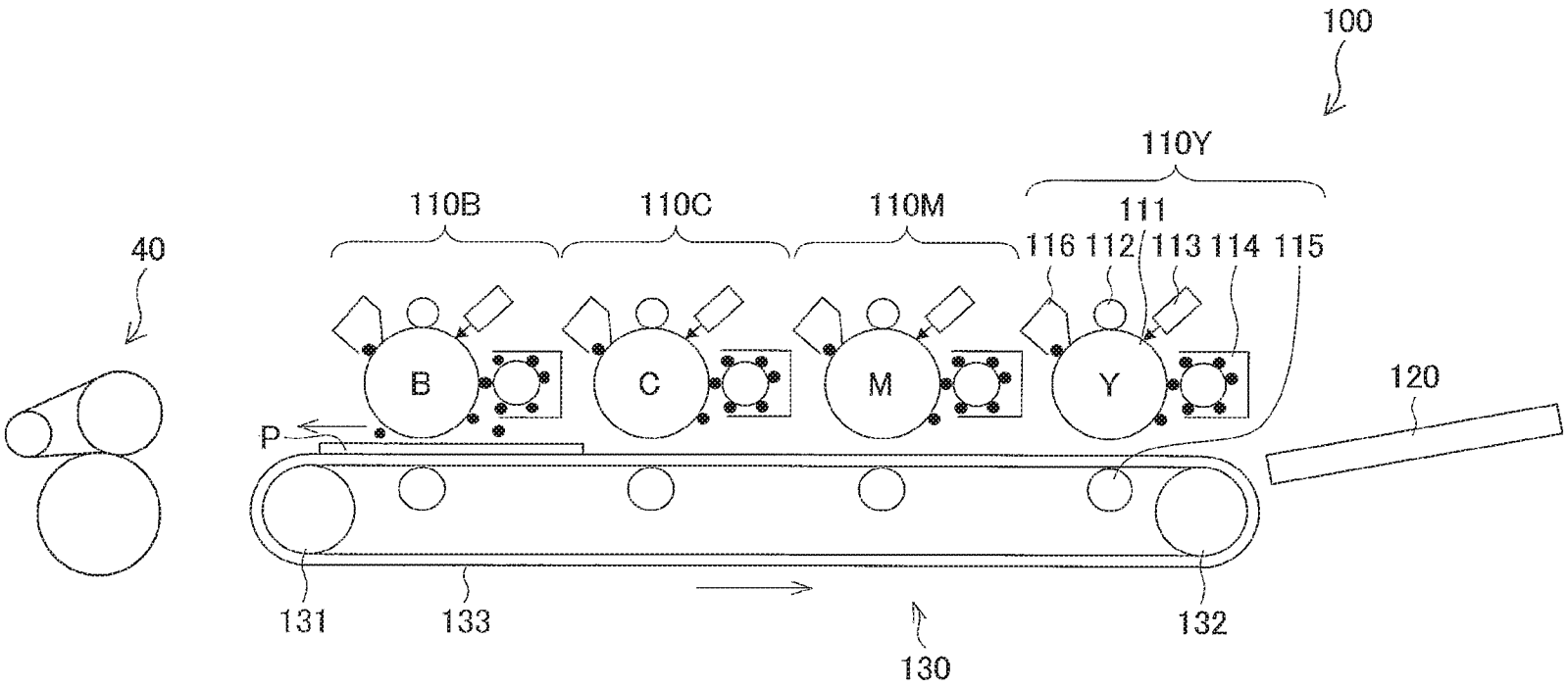
FIG. 2 is a cross-sectional view of an image forming apparatus that uses the toner of the embodiment of the present invention, the view schematically illustrating an internal configuration of the image forming apparatus.

FIG. 2 is a cross-sectional view of an image forming apparatus that uses the toner of the embodiment of the present invention, the view schematically illustrating an internal configuration of the image forming apparatus. FIG. 3 is a schematic cross-sectional view of a belt-type fixing device included in the image forming apparatus of FIG. 2.

The image forming apparatus 100 is an electrophotographic printer, and is a so-called tandem-type printer including four visible image forming units 110 (namely, a yellow visible image forming unit 110Y, a magenta visible image forming unit 110M, a cyan visible image forming unit 110C, and a black visible image forming unit 110B; referred to collectively as "visible image forming units 110" when the four visible image forming units are not distinguished from one another) arranged along a recording paper carrying path.

Specifically, the image forming apparatus 100 includes four visible image forming units 110 arranged along a path for carrying recording paper P which path extends from (i) a feeding tray 120 for feeding recording paper P (transfer medium; recording medium) to the visible image forming units 110 to (ii) a fixing device 40. The image forming apparatus 100 further includes an endless carrying belt 133 serving as recording paper carrying means 130 for carrying recording paper P. The visible image forming units 110 transfer their respective color toner images onto recording paper P so that those color toner images overlap one another. The fixing device 40 then fixes the toner images onto the recording paper P. This forms a full-color image.

The carrying belt 133 is hung around a driving roller 131 and an idling roller 132, and is moved around the two rollers at a controlled, predetermined peripheral velocity (within an approximate range of 150 mm/sec to 400 mm/sec; for example, at 220 mm/sec). The recording paper P is electrostatically adsorbed on the carrying belt 130 moving around, and is carried as a result.

The visible image forming units 110 each include a photoreceptor drum 111. The image forming apparatus 100 includes around each photoreceptor drum 111 a charging roller 112, exposure means (laser light emitting means) 113, a developing device 114, a transfer roller 115, and a cleaner 116.

The visible image forming unit 110Y includes a developing device Y that contains a developer including yellow toner. The visible image forming unit 110M includes a developing device M that contains a developer including magenta toner. The visible image forming unit 110C includes a developing device C that contains a developer including cyan toner. The visible image forming unit 110B includes a developing device B that contains a developer including black toner.

The developers each include the above-described toner of the present embodiment. The developers may each be a one component developer or two component developer. The one component developer may include either magnetic or nonmagnetic toner. The two component developer may include either magnetic or nonmagnetic carrier.

The visible image forming units 110 each transfer a toner image onto recording paper P through the following process: First, the charging roller 112 electrically charges a surface of the photoreceptor drum 111 uniformly. Next, the laser light emitting means 113 exposes the surface of the photoreceptor drum 111 with use of laser light in correspondence with image information to form an electrostatic latent image. Then, the developing device 114 supplies toner to the electrostatic latent image on the surface of the photoreceptor drum 111. This causes the electrostatic latent image to be developed (made visible) to form a toner image. The toner images formed on the respective surfaces of the photoreceptor drums 111 are sequentially transferred by the transfer rollers 115, each of which is supplied with a bias voltage of a polarity opposite to that of the toner images, onto recording paper P being carried by the carrying belt (carrying means) 130.

The recording paper P is then released from the carrying belt 133 at a curved portion thereof (that is, a portion at which the carrying belt 133 is wound around the driving roller 131) to be carried to the fixing device 40. After that, the fixing device 40 provides a moderate temperature and pressure to the recording paper P with use of a fixing belt heated to a predetermined temperature. This causes the toner on the recording paper P to be fused and then fixed on the recording paper P to form a fast image on the recording paper P.

Figure 3:
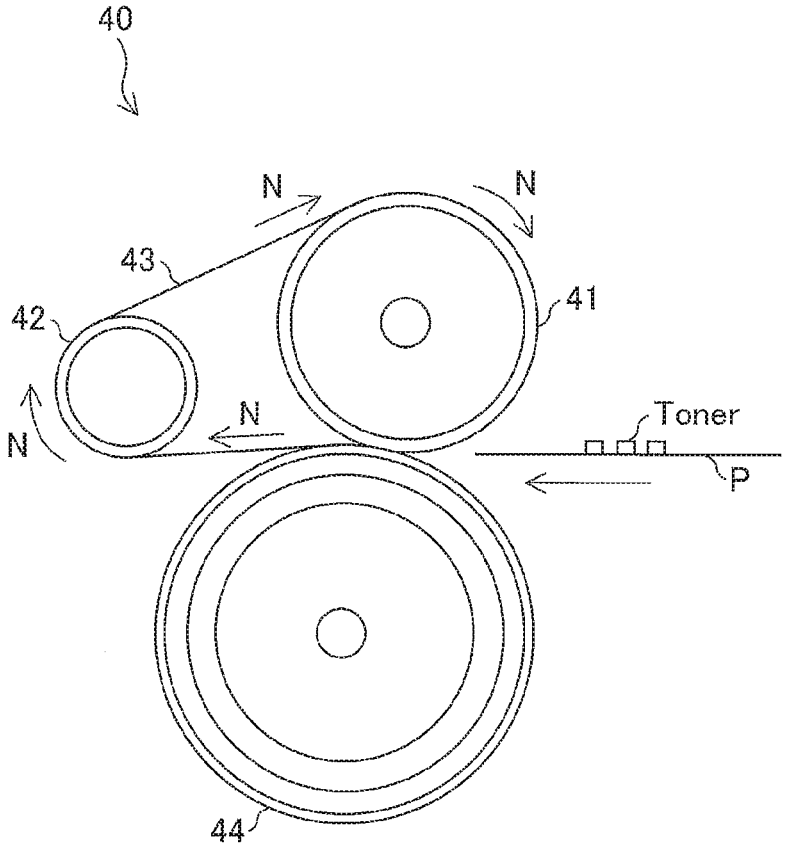
FIG. 3 is a schematic cross-sectional view of a belt-type fixing device included in the image forming apparatus of the embodiment of the present invention.

The fixing device (belt-type fixing device) 40, as illustrated in FIG. 3, includes (i) a heat roller 41, (ii) a peeling roller 42 having an axis direction parallel to that of the heat roller 41, (iii) an endless fixing belt 43 that is hung around the heat roller 41 and the peeling roller 42 and that is driven to move around the two rollers in response to rotation of the rollers, and (iv) a pressure roller 44 having an axis direction parallel to that of the heat roller 41. FIG. 3 shows an N direction to indicate the direction in which the fixing belt 43 is moved around.

The heat roller 41 and the peeling roller 42 are each provided at such a position that the fixing belt 43 is wound around the two rollers with its inside surface (hereinafter referred to as "inner surface") in contact with those rollers. The pressure roller 44 is so pressed against the heat roller 41 at a predetermined load (within an approximate range of 50 N to 300 N; for example, 200 N) that the fixing belt 43 is sandwiched between the pressure roller 44 and the heat roller 41. The pressure roller 44 has a periphery with a portion pressed against the heat roller 41 and another portion located downstream of the N direction from the pressed portion, and the fixing belt 43 is wound around the two portions with its outside surface (hereinafter referred to as "outer surface") in contact with those portions.

The description below uses (i) the term "real nip area" to refer to the pressed portion of the periphery of the pressure roller 44 and (ii) the term "imaginary nip area" to refer to the area of the periphery of the pressure roller 44 which area is located downstream from the pressed portion and at which area the fixing belt 43 is wound around the pressure roller 44 with its outer surface in contact with the pressure roller 44. The real nip area has a width within an approximate range of 5 mm to 20 mm (for example, 5 mm) along the N direction, whereas the imaginary nip area has a width within an approximate range of 8 mm to 30 mm (for example, 3 mm) along the N direction.

The fixing device 40 is arranged such that recording paper P passes through the real nip area and the imaginary nip area sequentially so that a toner image on the recording paper P is fixed on the recording paper P. When recording paper P passes through the real nip area and the imaginary nip area, the outer surface of the fixing belt 43 is in contact with that surface of the recording paper P on which a toner image has been formed, whereas the periphery of the pressure roller 44 is in contact with that surface of the recording paper P which is opposite to the surface on which a toner image has been formed.

The heat roller 41 is heated to a predetermined temperature (within an approximate range of 150° C. to 200° C.; for example, 190° C.), and transfers heat to the fixing belt 43 through the inner surface of the fixing belt 43. The fixing belt 43, to which the heat roller 41 has transferred heat, heats recording paper P passing through the real nip area and the imaginary nip area.

The heat roller 41 is made of a metal such as iron, stainless steel, aluminum, and copper or an alloy thereof (for example, an iron alloy). The heat roller 41 is a hollow cylindrical member (core bar) having a thickness within an approximate range of 0.2 mm to 1.0 mm (for example, 0.3 mm) and a diameter within an approximate range of 20 mm to 50 mm (for example, 30 mm). The heat roller 41 may be provided with an elastic layer at the periphery of the hollow cylindrical core bar, the elastic layer being made of a material such as silicone rubber and having a thickness within an approximate range of 0.5 mm to 2.0 mm (for example, 5 mm).

The heat roller 41 contains a heater lamp 45 for heating the heat roller 41. The heater lamp 45 emits light in response to a current from a control circuit (not shown) for infrared radiation. The infrared rays are absorbed by the heat roller 41 at its inside surface, which heats the inside surface and consequently heats the heat roller 41 in its entirety.

The pressure roller 44, as illustrated in FIG. 3, includes, for example, a core bar 44*a*, an elastic layer 44*b*, and a releasing layer 44*c* provided in that order outwardly from inside, and has a diameter within an approximate range of 20 mm to 50 mm (for example, 30 mm). The core bar 44*a* of the pressure roller 44 contains a heater lamp 48 for heating the pressure roller 44. The core bar 44*a* is made of a metal such as iron, stainless steel, aluminum, and copper or an alloy thereof (for example, an iron alloy), and is a hollow cylindrical member having a thickness within an approximate range of 1.0 mm to 5.0 mm (for example, 3 mm). The elastic layer 44*b* is made of a material such as silicone rubber, and has a thickness within an approximate range of 1.0 mm to 5.0 mm (for example, 5 mm). The releasing layer

44*c* corresponds to a surface layer of the pressure roller 44 (that is, a layer exposed at a peripheral surface). The releasing layer 44*c* is a tube made of a fluorine resin such as PFA (which is a copolymer of tetrafluoroethylene and perfluoroalkyl vinyl ether), polytetrafluoroethylene (PTFE), and a copolymer of PFA and PTFE, and has a thickness within an approximate range of 20 μm to 100 μm (for example, 50 μm).

The peeling roller 42 is provided to peel from the fixing belt 43 recording paper P having passed through the real nip area (real nip portion) and the imaginary nip area (imaginary nip portion). In other words, the peeling roller 42 included in the fixing device 40 causes the fixing belt 43 to curve at a position downstream of the recording paper carrying direction from the real nip area and the imaginary nip area so that the fixing belt 43 is moved away from the recording paper carrying direction. This arrangement allows recording paper P to be peeled from the fixing belt 43.

The peeling roller 42 is made of a metal such as iron, stainless steel, aluminum, and copper or an alloy thereof (for example, an iron alloy). The peeling roller 42 is a hollow cylindrical member (core bar) having a thickness within an approximate range of 0.3 mm to 2.0 mm (for example, 0.5 mm) and a diameter within an approximate range of 10 mm to 30 mm (for example, 14 mm).

EXAMPLES

The description below deals with specific Examples of the present invention. The present invention is, however, not limited to those Examples. The description below first deals with methods through which different physical property values were measured for the Examples and Comparative Examples.

[Softening Points (Tm) of Binder Resin and Grinding Aid Resin]

With use of a fluidity evaluation device (available from Shimazu Corporation, flow tester, model number: CFT-100C), a sample (1 g) is forced to flow from a die (having a nozzle diameter of 1 mm and a length of 1 mm) while the sample is heated at a rate of 6° C./min under a load of 20 kgf/cm$^2$ (9.8×105 Pa). The temperature at which the sample starts to flow is designated as the flow start temperature (Ti), whereas the temperature at which half the amount of the sample finishes flowing is designated as the softening point (Tm).

[Glass Transition Temperature Tg of Binder Resin and Grinding Aid Resin]

With use of a differential scanning calorimeter (available from Seiko Instruments and Electronics Co., Ltd. [currently Seiko Instruments Inc.], model number: DSC220), a sample (1 g) is heated at a rate of 10° C./min for DSC measurement in the form of a curve in accordance with Japanese Industrial Standard (JIs) K7121-1987. The DSC curve drawn shows a glass transition temperature (Tg) at the point of intersection of (i) a straight line that extends on a low-temperature side from a baseline of an endothermic peak (corresponding to a glass transition) on a high-temperature side with (ii) a tangent drawn with points at each of which the gradient is at its maximum with respect to a curve extending from a position at which the peak starts to rise to the apex of the peak.

[Melting Point of Release Agent]

With use of the differential scanning calorimeter (available from Seiko Instruments and Electronics Co., Ltd. [currently Seiko Instruments Inc.], model number: DSC220), a sample (1 g) is heated from 20° C. to 200° C. at a rate of 10° C./min, and is then quenched from 200° C. to 20° C. This operation is carried out twice for DSC measurement in the form of a curve. The temperature at an endothermic peak (corresponding to melting) in the DSC curve drawn during the second operation is designated as the melting point of the release agent.

[Volume Average Particle Size and Coefficient of Variation of Toner Particles]

A sample (20 mg) and sodium alkyl ether sulfate (1 ml) are added to an electrolyte solution (50 ml, available from Beckman Coulter, Inc., product name: ISOTON-II), and are dispersed in the electrolyte solution at a frequency of 20 kHz for 3 minutes with use of an ultrasonic dispersing device (available from As One Corporation, desktop double-frequency ultrasonic cleaner, type: VS-D100) to provide a measurement sample. This measurement sample is measured with use of a particle size analyzer (available from Beckman Coulter, Inc., type: Multisizer 3) under conditions of an aperture diameter of 100 μm and a measurement particle count of 50,000 count. The volume average particle size of the sample particles is calculated from the volume particle size distribution of the sample particles. The coefficient of variation of the sample particles is calculated from the standard deviation of the volume particle size distribution.

[Weight Average Molecular Weight of Toner Particles]

The weight average molecular weight Mw of the toner particles was found from a molecular weight distribution based on gel permeation chromatography (GPC). Although a toner particle is actually not a molecule but a mixture, the present embodiment handles toner particles as molecules, hence the weight average "molecular" weight Mw. GPC for the Examples involves THF as an eluant. Thus, no contribution is made to Mw by any THF-insoluble component.

[Weight Proportion of THF-Insoluble Gel Component in Toner Particles]

The weight proportion of a THF-insoluble gel component in the toner particles was found through a simple quantitative determination method including the following steps (i) to (vii):

(i) Put 0.1 g of the toner particles into a sample bottle.

(ii) Add 50 ml of THF into the sample bottle of (i) and stir the mixture for 1 hour with use of a stirrer.

(iii) Weigh a membrane filter (made of PTFE and having a pore size of 3.0 μm).

Figure 4:
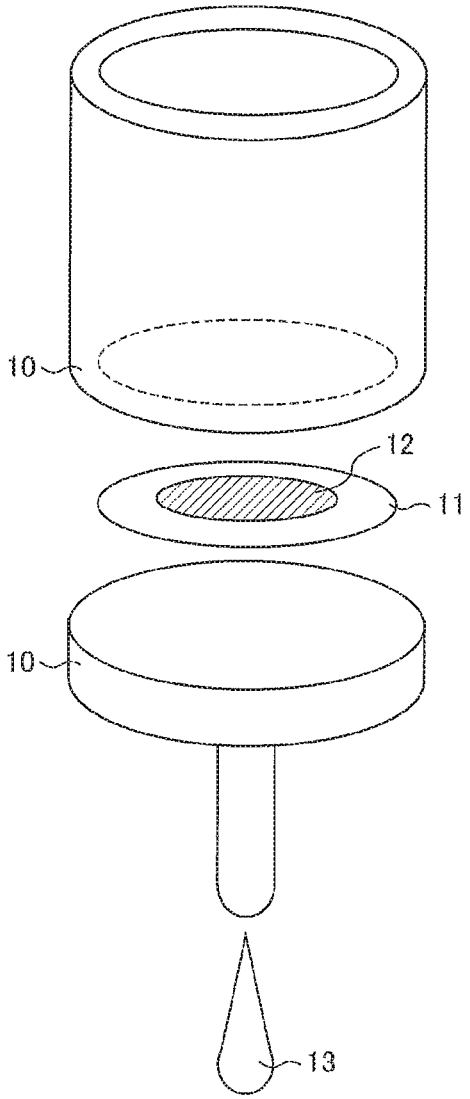
FIG. 4 is a diagram schematically illustrating a Kiriyama funnel and membrane filter used in Examples of the present invention.

(iv) Filter the stirred mixture of (ii) under reduced pressure with use of a Kiriyama funnel to which the membrane filter of (iii) has been attached (see FIG. 4, which is a diagram schematically illustrating the Kiriyama funnel and the membrane filter). Specifically, attach the membrane filter 11 to the Kiriyama funnel 10 and filter, with use of the Kiriyama funnel 10, the THF in which the toner particles are dissolved, so that there is deposited on the membrane filter 11 a precipitate 12 which did not pass through the membrane filter 11. A filtrate 13 that has passed through the membrane filter 11 contains a component dissolved in THF, whereas the precipitate 12 contains a THF-insoluble component.

(v) Softly clean, with n-hexane, the precipitate remaining on the membrane filter after the reduced pressure filtration of (iv) (that is, a component that did not pass through the membrane filter) to dissolve the THF-insoluble release agent in the n-hexane for removal. The gel component, which is insoluble in n-hexane, remains on the membrane filter.

(vi) After the reduced pressure filtration, dry the membrane filter and the precipitate of (v) remaining thereon at 100° C. for 1 hour, allow the membrane filter and the precipitate to stand until they have room temperature, and weigh the membrane filter.

(vii) Calculate the gel component with the following equation (where the THF-insoluble matter is regarded as a gel component):

$$\text{Gel component(weight \%)}=\{(\text{Dry weight of}(vi))-(\text{Weight of}(iii))\}\div 0.1\times 100$$

Example 1

The present Example used the following materials for toner:

Binder resin: polyester resin A (with a glass transition temperature of 62° C., a softening point of 128° C., and a weight average molecular weight of 65,200), 83 weight %

Coloring agent: C.I. Pigment Blue 15:3 (available from DIC Corporation), 4 weight %

Release agent: release agent A (paraffin wax with a melting point of 69° C., available from Nippon Seiro Co., Ltd., product name: HNP11), 7 weight %

Charge control agent: salicylic acid compound (available from Orient Chemical Industries Ltd., product name: Bontron E84), 1 weight %

Grinding aid resin: styrene resin A (with a glass transition temperature of 64° C., a softening point of 125° C., and a weight average molecular weight of 6400), 5 weight %

These toner materials were premixed for 3 minutes in a Henschel mixer (available from Nippon Coke & Engineering Co., Ltd., type: FM20C) and were then fused and kneaded in an open-roll continuous mill (available from Nippon Coke & Engineering Co., Ltd., type: MOS100-400) to provide a fused and kneaded product.

The fused and kneaded product was cooled on a cooling belt and was then roughly ground in a speed mill provided with a screen having a diameter of 2 mm. Next, the roughly ground particles were finely ground in a jet mill (available from Nippon Coke & Engineering Co., Ltd., type: CGS-16) and were classified with use of an Elbow-Jet classifier (available from Nittetsu Mining Co., Ltd., type: EJ-LABO) to provide toner particles 1, which had a volume average particle size of 6.8 μm and a coefficient of variation CV of 23.

Example 2

The present Example used materials similar to those used in Example 1 and a production method similar to that used in Example 1 except that the styrene resin A was used in an amount of 10 parts by weight and the polyester resin A was used in an amount of 78 parts by weight. The present Example thus produced toner particles 2, which had a volume average particle size of 6.9 μm and a coefficient of variation CV of 21.

Example 3

The present Example used materials similar to those used in Example 1 and a production method similar to that used in Example 1 except that the styrene resin A was used in an amount of 13 parts by weight and the polyester resin A was used in an amount of 75 parts by weight. The present Example thus produced toner particles 3, which had a volume average particle size of 6.9 μm and a coefficient of variation CV of 22.

Example 4

The present Example used materials similar to those used in Example 1 and a production method similar to that used in Example 1 except that the styrene resin A was used in an amount of 3 parts by weight and the polyester resin A was used in an amount of 85 parts by weight. The present Example thus produced toner particles 4, which had a volume average particle size of 6.7 μm and a coefficient of variation CV of 21.

Example 5

The present Example used materials similar to those used in Example 2 and a production method similar to that used in Example 2 except that the polyester resin A was replaced by a polyester resin B (with a glass transition temperature of 52° C., a softening point of 119° C., and a weight average molecular weight of 51,300). The present Example thus produced toner particles 5, which had a volume average particle size of 6.8 μm and a coefficient of variation CV of 23.

Example 6

The present Example used materials similar to those used in Example 2 and a production method similar to that used in Example 2 except that the polyester resin A was replaced by a polyester resin C (with a glass transition temperature of 66° C., a softening point of 139° C., and a weight average molecular weight of 11,200). The present Example thus produced toner particles 6, which had a volume average particle size of 7.0 μm and a coefficient of variation CV of 24.

Example 7

The present Example used materials similar to those used in Example 2 and a production method similar to that used in Example 2 except that the polyester resin A was replaced by a polyester resin D (with a glass transition temperature of 61° C., a softening point of 141° C., and a weight average molecular weight of 197,400). The present Example thus produced toner particles 7, which had a volume average particle size of 6.8 μm and a coefficient of variation CV of 23.

Comparative Example 1

The present Comparative Example used materials similar to those used in Example 1 and a production method similar to that used in Example 1 except that no styrene resin was used and the polyester resin A was used in an increased amount of 88 parts by weight. The present Comparative Example thus produced toner particles 8, which had a volume average particle size of 6.6 μm and a coefficient of variation CV of 24.

Comparative Example 2

The present Comparative Example used materials similar to those used in Example 1 and a production method similar to that used in Example 1 except that the styrene resin A was used in an amount of 15 parts by weight and the polyester resin A was used in an amount of 73 parts by weight. The present Comparative Example thus produced toner particles 9, which had a volume average particle size of 6.8 μm and a coefficient of variation CV of 21.

Comparative Example 3

The present Comparative Example used materials similar to those used in Example 2 and a production method similar to that used in Example 2 except that the polyester resin A was replaced by a polyester resin E (with a glass transition temperature of 49° C., a softening point of 109° C., and a weight average molecular weight of 41,000). The present Comparative Example thus produced toner particles 10, which had a volume average particle size of 6.6 μm and a coefficient of variation CV of 22.

Comparative Example 4

The present Comparative Example used materials similar to those used in Example 2 and a production method similar to that used in Example 2 except that the polyester resin A was replaced by a polyester resin F (with a glass transition temperature of 68° C., a softening point of 142° C., and a weight average molecular weight of 12,400). The present Comparative Example thus produced toner particles 11, which had a volume average particle size of 6.9 μm and a coefficient of variation CV of 24.

Comparative Example 5

The present Comparative Example used materials similar to those used in Example 2 and a production method similar to that used in Example 2 except that the polyester resin A was replaced by a polyester resin G (with a glass transition temperature of 58° C., a softening point of 145° C., and a weight average molecular weight of 11,300). The present Comparative Example thus produced toner particles 12, which had a volume average particle size of 6.7 μm and a coefficient of variation CV of 22.

Table 1 shows various physical properties of the toner particles produced in Examples 1 to 7 and Comparative Examples 1 to 5.

[Preparation of Two Component Developer]

Next, two component developers were prepared as follows:

First, 100 parts by weight of the toner particles produced in each of Examples 1 to 7 and Comparative Examples 1 to 5 were mixed with (i) 0.7 part by weight of silica particles hydrophobized with a silane coupling agent and having an average primary particle size of 20 nm and (ii) 1 part by weight of titanium oxide to provide toner with external additives. Next, this toner and ferrite core carrier (magnetic carrier) having a volume average particle size of 60 μm were mixed with each other in their respective amounts so adjusted that the toner would have a density of 7% with respect to the total amount of a two component developer being prepared. This produced a two component developer having a toner density of 7%. The description below uses the expressions the two component developers of Examples 1 to 7 and Comparative Examples 1 to 5" to refer to the two component developers prepared with use of the toner particles produced in Examples 1 to 7 and Comparative Examples 1 to 5.

[Evaluations]

The evaluations below were performed of (i) the toner particles of each of Examples 1 to 7 and Comparative Examples 1 to 5 and (ii) the two component developers containing the toner particles.

<Toner Grindability>

Grindability of toner during production thereof was evaluated as follows:

Flakes as roughly ground were put into a jet mill (available from Nippon Coke & Engineering Co., Ltd., type: CGS-16), which was set to have a condition for a particle size (6.3±0.3 μm) that would result in a particle size of 7.0 μm after classification and which was then operated for 1 hour. The evaluation was performed on the basis of the

TABLE 1

| Examples | Mw | Gel component | Area occupancy of components each with molecular weight of 500 to 1500 | Main resin | Additive resin | Amount of additive resin (wt %) | Toner name |
|---|---|---|---|---|---|---|---|
| Example 1 | 49790 | 1.6 | 6.3% | Polyester A | Styrene A | 5 | Toner particles 1 |
| Example 2 | 42623 | 1.5 | 8.3% | Polyester A | Styrene A | 10 | Toner particles 2 |
| Example 3 | 39567 | 1.5 | 9.6% | Polyester A | Styrene A | 13 | Toner particles 3 |
| Example 4 | 46750 | 1.6 | 5.1% | Polyester A | Styrene A | 3 | Toner particles 4 |
| Example 5 | 31257 | 1.4 | 9.8% | Polyester B | Styrene A | 10 | Toner particles 5 |
| Example 6 | 95263 | 3.4 | 5.3% | Polyester C | Styrene A | 10 | Toner particles 6 |
| Example 7 | 92153 | 4.8 | 4.2% | Polyester D | Styrene A | 10 | Toner particles 7 |
| Comparative Example 1 | 40831 | 1.5 | 3.7% | Polyester A | — | 0 | Toner particles 8 |
| Comparative Example 2 | 38796 | 1.3 | 12.5% | Polyester A | Styrene A | 15 | Toner particles 9 |
| Comparative Example 3 | 28964 | 1.2 | 9.7% | Polyester E | Styrene A | 10 | Toner particles 10 |
| Comparative Example 4 | 108172 | 3.9 | 5.4% | Polyester F | Styrene A | 10 | Toner particles 11 |
| Comparative Example 5 | 91591 | 5.7 | 5.2% | Polyester G | Styrene A | 10 | Toner particles 12 |

amount of roughly ground flakes that had been supplied by the time the one-hour operation finished.

The grindability was evaluated on the basis of the obtained result with reference to the following criteria:

E: Excellent (the supply amount of roughly ground flakes of not less than 2000 g)

G: Good (the supply amount of roughly ground flakes of not less than 1500 g and less than 2000 g)

F: Fair (the supply amount of roughly ground flakes of not less than 1000 g and less than 1500 g)

P: Poor (the supply amount of roughly ground flakes of less than 500 g)

<Fixing Property>

The fixing property of each of the two component developers was evaluated as follows:

With use of a commercially available copying machine (available from Sharp Corporation, type: MX-3600FN) modified for evaluation, a fixed image was formed from each of the two component developers.

First, a sample image having a solid image portion (in the shape of a rectangle with a height of 20 mm and a width of 50 mm) was formed in the form of an unfixed image on recording paper (available from Sharp Corporation, PPC sheet, type: SF-4AM3) serving as a recording medium. During the formation of the sample image, the copying machine was adjusted so that capsule toner in the solid image portion would adhere to the recording paper in an amount of 0.5 mg/cm$^2$.

Next, a fixed image was formed with use of the belt-type fixing device 40 illustrated in FIG. 3.

The temperature range within which neither cold offset nor hot offset would occur was determined while (i) the speed of the fixing process was set to 150 mm/sec and (ii) the temperature of the fixing belt was raised from 130° C. in increments of 5° C. The temperature range was designated as "non-offset fixing range". The terms "hot offset" and "cold offset" are each herein defined as a phenomenon in which capsule toner fails to be fixed on recording paper during the fixing process to remain adhering to the fixing belt and then adheres to recording paper after a full rotation of the fixing belt.

The non-offset fixing range was determined on the basis of the obtained result with use of the following equation:

Non-offset fixing range(° C.)=Fixing upper-limit temperature(° C.)−Fixing lower-limit temperature(° C.)

The fixing property of each two component developer was evaluated on the basis of the obtained result with reference to the following criteria:

E: Excellent (with a non-offset fixing range of not less than 50° C.)

G: Good (with a non-offset fixing range of not less than 35° C. and less than 50° C.)

F: Fair (with a non-offset fixing range of not less than 25° C. and less than 35° C.)

P: Poor (with a non-offset fixing range of less than 25° C.)

<Image Stability>

The image stability of each of the two component developers was evaluated as follows:

The two component developer of each of Examples 1 to 7 and Comparative Examples 1 to 5 was put into a commercially available copying machine (product name: MX-3600FN, available from Sharp Corporation). The copying machine was adjusted so that the toner would adhere to the photoreceptor in an amount of 0.4 mg/cm$^2$ during a printing process. The initial image density (ID0) of an image printed and the image density (ID10k) of an image printed after 10,000 (hereinafter referred to as "10k") sheets of printing were measured with use of a colorimeter (product name: X-Rite938, available from X-Rite, Inc.).

The image stability rate was calculated with use of the equation below. The image stability was then evaluated on the basis of the returned value as follows:

Image stability rate (%)=(ID10*k*/ID0)×100

E (excellent): Image stability rate of not less than 95%

G (good): Image stability rate of not less than 90% and less than 95%

F (fair): Image stability rate of not less than 80% and less than 90%

P (poor): Image stability rate of less than 80%

[Overall Evaluation]

Overall evaluations were performed on the basis of the results of evaluating grindability, fixing property, and image stability.

E (excellent): Each evaluation resulted in E.

G (good): Each evaluation resulted in E or G.

F (fair): At least one evaluation resulted in F, but no evaluation resulted in P.

P (Poor): At least one evaluation resulted in P, or each evaluation resulted in F.

Table 2 shows the above evaluation results.

TABLE 2

| Examples | Grindability | Fixing property | Image stability | Overall evaluations |
|---|---|---|---|---|
| Example 1 | G | G | G | G |
| Example 2 | E | E | E | E |
| Example 3 | F | F | E | F |
| Example 4 | F | G | G | F |
| Example 5 | F | F | G | F |
| Example 6 | F | E | G | F |
| Example 7 | F | G | G | F |
| Comparative Example 1 | P | E | F | P |
| Comparative Example 2 | P | P | G | P |
| Comparative Example 3 | P | P | F | P |
| Comparative Example 4 | P | F | F | P |
| Comparative Example 5 | P | F | P | P |

The above evaluations prove that toner particles have an overall evaluation of F or better in the case where the toner has a weight average molecular weight Mw of 30,000≤Mw≤95,263 as determined from a molecular weight distribution based on gel permeation chromatography (GPC), includes a tetrahydrofuran-insoluble gel component at a weight proportion of less than 5%, and includes components each having a molecular weight of 500 to 1500 which components have an area occupancy of 4% to 10% on a chart of the molecular weight distribution based on GPC.

The Comparative Examples can be analyzed as follows: Comparative Example 1 used the polyester resin A but not a styrene resin, and resulted in poor grindability. Comparative Example 2 used an excessive amount of the styrene resin A, and resulted in excessive grinding and poor production efficiency on the contrary. Comparative Example 3 used the polyester E that had an excessively small weight average molecular weight, which led not only to poor grindability but also to poor fixing property. Comparative Example 4 used the polyester F that had an excessively large weight average molecular weight, which led to poor grindability. Comparative Example 5 used the polyester G that had an excessively high gel component proportion, which led to poor grindability.

The toner of any of Examples 1 through 7, which is for use in a two component developer, has low-temperature fixing property, resistance to hot offset, and image stability even when used in a belt-type fixing device and can be produced in a short time period.

[Recap]

In order to solve the above problem, a toner of one mode of the present invention is a toner, including: a binder resin; a coloring agent; a release agent; and a charge control agent, the toner having a weight average molecular weight Mw of 30,000≤Mw≤95,263 as determined from a molecular weight distribution based on gel permeation chromatography (GPC), the toner including a tetrahydrofuran-insoluble gel component at a weight proportion of less than 5%, the toner including components each having a molecular weight of 500 to 1500 which components have an area occupancy of 4% to 10% on a chart of the molecular weight distribution based on GPC.

With the above arrangement, the toner particles, which have a weight average molecular weight Mw of 30,000≤Mw≤95,263, are advantageously high in elasticity, and also provide good releasability in a case where a toner image is fixed with use of a belt-type fixing device. Toner particles simply having a weight average molecular weight Mw within the above range will, however, be poor in grindability, and thus result in poor production efficiency. Such toner particles will be even more difficult to grind in a case where the toner particles contain a tetrahydrofuran (THF)-insoluble gel component at a weight proportion of less than 5% which gel component may serve as a grinding start point when the toner particles are ground. In view of this, the toner particles contain components each with a molecular weight of 500 to 1500, the components having an area occupancy of 4% to 10% on a chart of the molecular weight distribution based on GPC. This serves to provide a new grinding start point inside the toner particles for improved grindability, that is, improved toner productivity.

The weight average molecular weight Mw of toner particles is determined from a molecular weight distribution based on GPC. Although a toner particle is actually not a molecule but a mixture, the present specification handles toner particles as molecules, hence the weight average "molecular" weight Mw.

Further, in a case where the components each with a molecular weight of 500 to 1500 have an area occupancy of 4% to 10% on a chart of the molecular weight distribution based on GPC, the toner as fixed will advantageously have a smooth surface and a stable gloss value.

If the components each with a molecular weight of 500 to 1500 have an area occupancy of less than 4% on a chart of the molecular weight distribution based on GPC, the grindability improving effect mentioned above may not be sufficient. If the area occupancy is greater than 10%, the toner particles will be excessively ground, with the result of a poor yield and decreased production efficiency.

The above arrangement can, as described above, provide toner that has improved productivity in terms of grindability and a stable gloss value after being fixed.

The toner of one mode of the present invention may further include an additive resin in addition to the binder resin which additive resin has a physical property value different from a physical property value of the binder resin.

It is difficult, merely with use of a single binder resin, to produce toner having 30,000≤Mw≤95,263. Further, a single binder resin has a single physical property value, and thus does not likely serve as a grinding start point, that is, does not likely result in improved grindability. With the above arrangement, the toner contains, in addition to the binder resin, an additive resin having a physical property value different from that of the binder resin. This allows the toner to have 30,000≤Mw≤95,263 for improved grindability.

The toner of one mode of the present invention may be arranged such that the binder resin is a polyester resin; and the additive resin is a styrene resin.

Using a polyester resin as the binder resin and a styrene resin as the additive resin facilitates adjusting the components each with a molecular weight of 500 to 1500 so that the components have an area occupancy of 4% to 10% on the chart of the molecular weight distribution based on GPC.

The components each having a relatively low molecular weight (that is, a molecular weight of 500 to 1500) are easily adjustable in a case where the additive resin is a styrene resin, whereas the main resin (binder resin), other than the styrene resin, is suitably a polyester resin. Further, a polyester resin and a styrene resin have low compatibility with each other, which allows the styrene resin as an additive resin to easily serve as a grinding start point. This arrangement can enhance the grindability improving effect.

In order to solve the above problem, a two component developer of one mode of the present invention is a two component developer including: the toner according to any one mode of the present invention; and a magnetic carrier.

The two component developer contains toner that has increased productivity and that allows a high quality image to be formed with high transfer efficiency. Such a two component developer, as a result, has increased productivity and high quality.

In order to solve the above problem, an image forming apparatus of one mode of the present invention is an image forming apparatus, including: a photoreceptor; a developing device for making visible an electrostatic latent image on the photoreceptor with use of a toner to form a toner image; a transfer device for transferring the toner image onto a transfer medium; and a belt-type fixing device for fixing the toner image on the transfer medium, the toner being the toner according to any one mode of the present invention.

The above arrangement, which uses toner of one mode of the present invention, allows a high quality toner image to be formed.

In order to solve the above problem, an image forming method of one mode of the present invention is an image forming method, including the steps of: making visible an electrostatic latent image on a photoreceptor with use of a toner to form a toner image; transferring the toner image onto a transfer medium; and fixing the toner image with use of a belt-type fixing device, the toner being the toner according to any one mode of the present invention.

The above arrangement, which uses toner of one mode of the present invention, allows a high quality toner image to be formed.

The present invention is not limited to the description of the embodiment above, but may be altered by a skilled person within the scope of the claims. Any embodiment based on a proper combination of technical means modified appropriately without departing from the scope of the present invention is encompassed in the technical scope of the present invention.

INDUSTRIAL APPLICABILITY

The present invention can serve as toner for use in an electrophotographic image forming apparatus such as a printer, a copying machine, a facsimile, and a multifunction printer (MFP).

REFERENCE SIGNS LIST

40 fixing device
100 image forming apparatus

The invention claimed is:

1. A method for producing ground toner, the toner including:

a binder resin;
a coloring agent;
a release agent; and
a charge control agent,
the method comprising the steps of:

(a) selecting and mixing (i) the binder resin, (ii) an additive resin having a weight average molecular weight smaller than a weight average molecular weight of the binder resin, (iii) the coloring agent, (iv) the release agent, and (v) the charge control agent so that the toner has a weight average molecular weight Mw of $30{,}000 \leq Mw \leq 95{,}263$ as determined from a molecular weight distribution based on gel permeation chromatography (GPC), that the toner includes a tetrahydrofuran-insoluble gel component at a weight proportion of less than 5%, and that the toner includes components each having a molecular weight of 500 to 1500 which components have an area occupancy of 4% to 10% on a chart of the molecular weight distribution based on GPC;

(b) fusing and kneading a mixture resulting from the step (a); and (c) grinding a fused and kneaded product resulting from the step (b).

2. The method according to claim 1,
wherein:
the binder resin is a polyester resin; and
the additive resin is a styrene resin.

3. A method for producing a two component developer,
the method comprising:
the steps (a), (b), and (c) as recited in claim 1,
the method further comprising the step of
adding a magnetic carrier to the ground toner and mixing the magnetic carrier with the ground toner.

* * * * *